US007496313B2

(12) United States Patent
Saito et al.

(10) Patent No.: US 7,496,313 B2
(45) Date of Patent: Feb. 24, 2009

(54) IMAGE FORMING DEVICE HAVING A ROTATABLE FRONT COVER WITH BENT PORTIONS

(75) Inventors: Yasuhide Saito, Saitama (JP); Michita Igarashi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 80 days.

(21) Appl. No.: 11/529,402

(22) Filed: Sep. 29, 2006

(65) Prior Publication Data

US 2007/0230996 A1 Oct. 4, 2007

(30) Foreign Application Priority Data

Apr. 4, 2006 (JP) ..... 2006-103314

(51) Int. Cl.
*G03G 15/00* (2006.01)

(52) U.S. Cl. ..... 399/107; 399/110

(58) Field of Classification Search ..... 399/107, 399/110, 124, 125

See application file for complete search history.

(56) References Cited

U.S. PATENT DOCUMENTS 6,075,958 A * 6/2000 Gotoh et al. ..... 399/124
6,647,223 B2 * 11/2003 Ishii ..... 399/124 X
7,266,325 B2 * 9/2007 Hirose et al. ..... 399/107
2004/0085431 A1 5/2004 Asuwa et al.
2004/0091290 A1 5/2004 Yamada et al.

FOREIGN PATENT DOCUMENTS

| | | | |
|---|---|---|---|
| JP | 2000-79739 | A | 3/2000 |
| JP | 2000-190595 | A | 7/2000 |
| JP | 2000-231321 | A | 8/2000 |
| JP | 2002-351282 | A | 12/2002 |
| JP | 2004-34648 | A | 2/2004 |

* cited by examiner

*Primary Examiner*—Sandra L Brase
(74) *Attorney, Agent, or Firm*—Sughrue Mion, PLLC

(57) ABSTRACT

The present invention provides an image forming device including: a main body frame at which an opening is provided; an image forming section that is accommodated in the main body frame, and that forms an image on a recording medium; an opening/closing cover that is rotatably supported and opens and closes the opening, a bent portion of the opening/closing cover that is bent toward the main body frame covering an edge portion, at the side of the opening, of the main body frame in a state in which the opening/closing cover is closed; and a fixed cover that is provided integrally with the main body frame, and that covers the bent portion in the state in which the opening/closing cover is closed.

18 Claims, 10 Drawing Sheets

IMAGE FORMING DEVICE HAVING A ROTATABLE FRONT COVER WITH BENT PORTIONS

BACKGROUND

1. Technical Field

The present invention relates to an image forming device in which an opening provided at a main body frame is opened and closed by an opening/closing cover which is rotatably mounted to the main body frame.

2. Related Art

Image forming devices which form an image by transferring and fixing a toner image, which is formed on a photosensitive body (image carrier) and an intermediate transfer belt, onto a recording sheet (a recording medium), and image forming devices which form an image by ejecting ink onto an recording sheet from an inkjet recording head, are conventionally known. In such image forming devices, an opening provided at a main body frame is opened and closed by an opening/closing cover. With opening the opening/closing cover, maintenance, replacement, and the like of units accommodated in the main body frame can be carried out.

An image forming device such as that described above is limited to a structure in which the edge portions of the opening/closing cover cover non-exposed portions of a fixed cover which is fixed to the main body frame, for reasons such as: it is necessary to prevent the outer surface of the opening/closing cover from being scratched, due to the outer surface of the opening/closing cover and the fixed cover sliding-and-rubbing against one another, at the time of opening and closing the opening/closing cover, and the main body frame must be prevented from being exposed from between the opening/closing cover and the fixed cover in the state in which the opening/closing cover is closed, and the like. The degrees of freedom in designing the exterior of the image forming device are therefore decreased.

SUMMARY

An image forming device of an aspect of the present invention includes: a main body frame at which an opening is provided; an image forming section that is accommodated in the main body frame, and that forms an image on a recording medium; an opening/closing cover that is rotatably supported and opens and closes the opening, a bent portion of the opening/closing cover that is bent toward the main body frame covering an edge portion, at the side of the opening, of the main body frame in a state in which the opening/closing cover is closed; and a fixed cover that is provided integrally with the main body frame, and that covers the bent portion in the state in which the opening/closing cover is closed.

BRIEF DESCRIPTION OF THE DRAWINGS

An exemplary embodiment of the invention will be described in detail with reference to the following figures, wherein.

DETAILED DESCRIPTION

Figure 1:
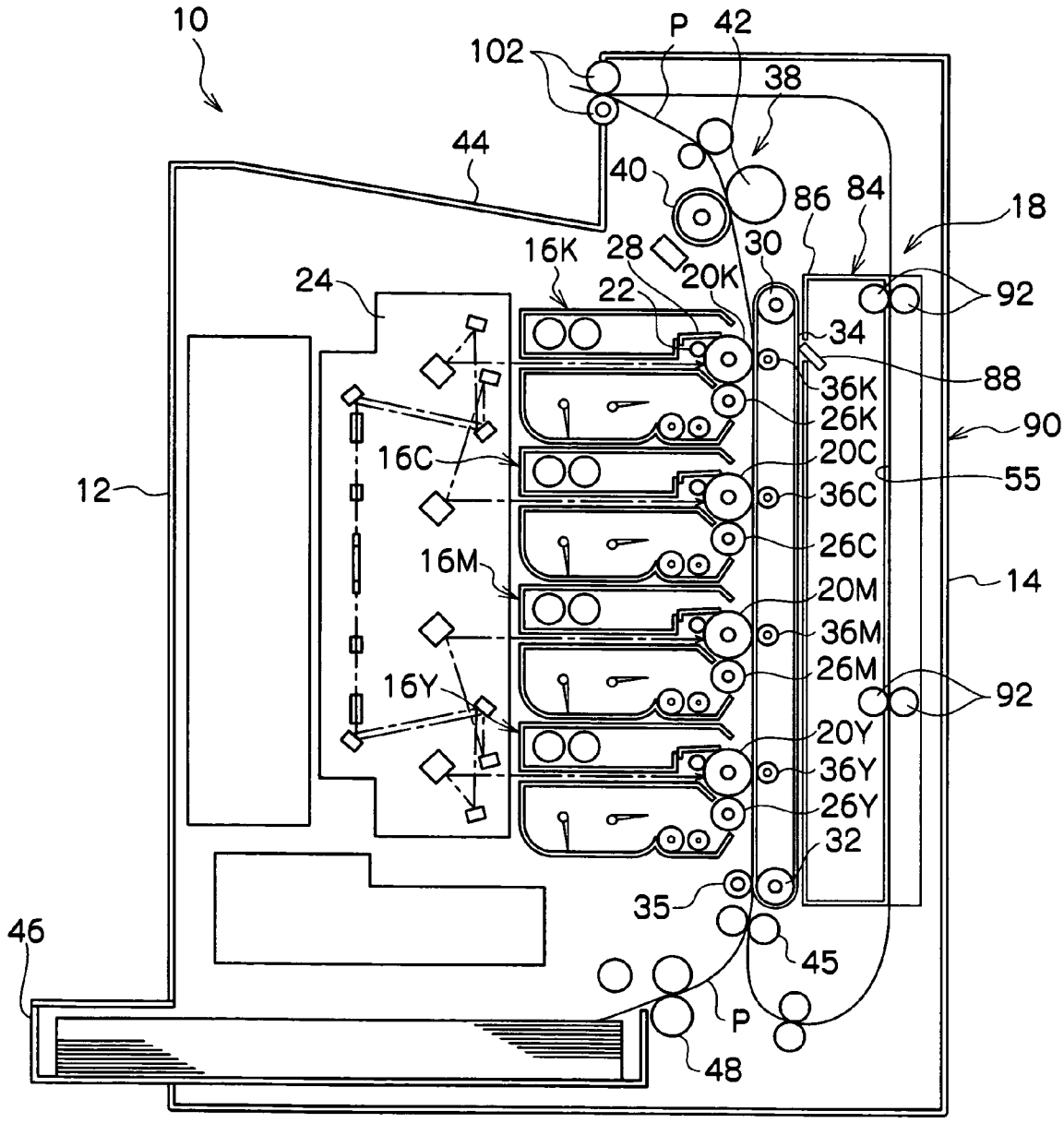
FIG. 1 is a schematic side view showing the structure of an image forming device of an exemplary embodiment of the present invention.

An exemplary embodiment of the present invention will be described hereinafter on the basis of the examples shown in the figures. Note that, in the figures, members which are provided for the respective colors of yellow (Y), magenta (M), cyan (C), and black (K) may have the corresponding letter "Y", "M", "C", "K" follow the reference numeral thereof.

Figure 2:
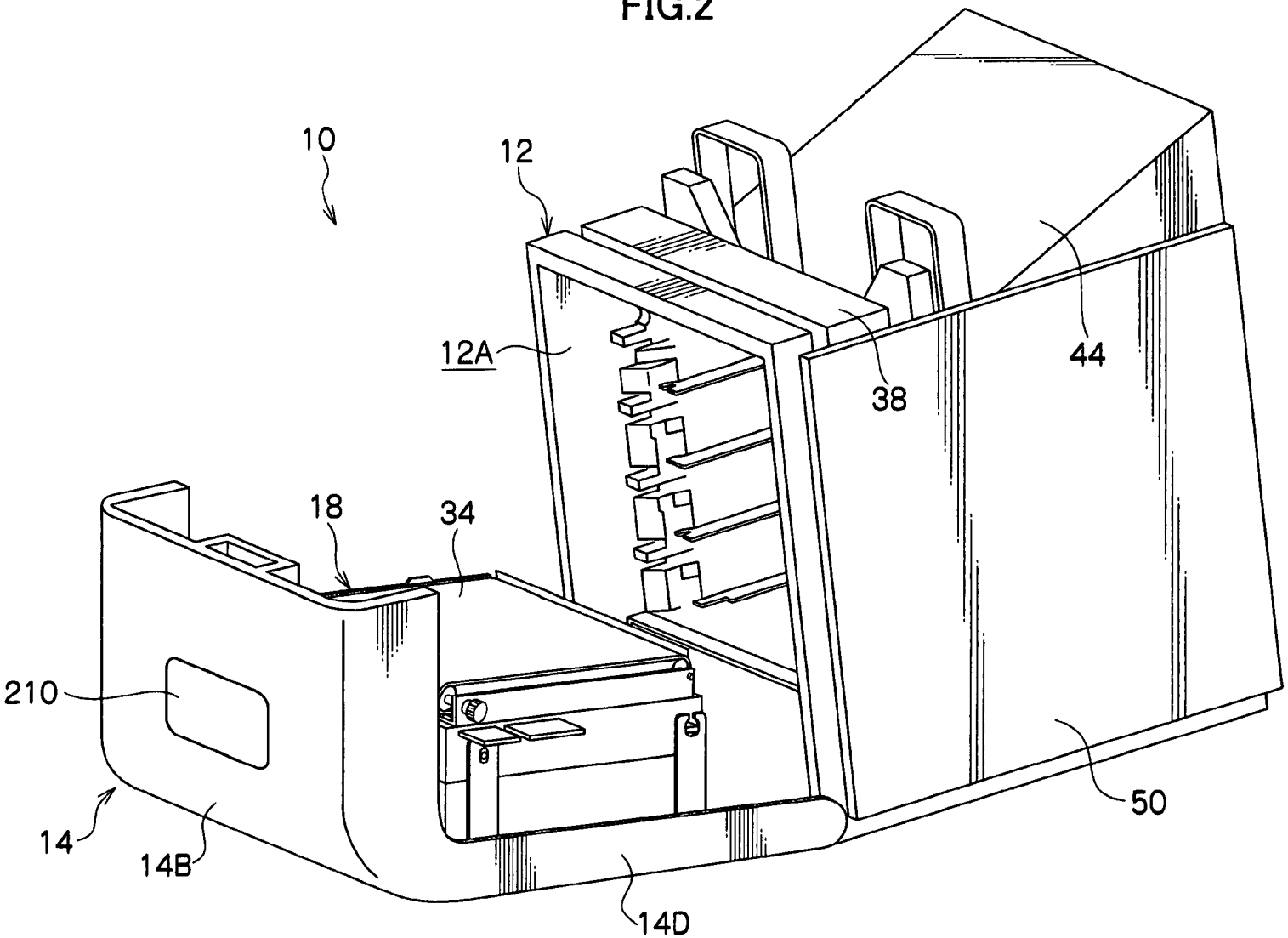
FIG. 2 is a perspective view showing the image forming device of FIG. 1.

First, a summary of an image forming device 10 relating to the exemplary embodiment of the present invention will be described. As shown in FIGS. 1 and 2, the image forming device 10 includes: a main body frame 12 which removably accommodates image carriers (photosensitive bodies) 20 and developing units 16; and a front cover 14 which opens and closes the image carriers 20, the developing units 16, and a fixing device 38 which will be described later, that is, opens and closes a front surface of the device and a top surface of the device. A conveying unit 18 including a conveying belt 34, which can attract and convey a recording sheets P, and the like is removably mounted to the front cover 14. The front cover 14 is structured by a front surface cover portion 14A which opens and closes the front surface of the device, and a top surface cover portion 14B which opens and closes the top surface of the device, so as to be formed in the shape of the letter L as seen in side view.

The developing unit 16 includes a charging roller 22, an optical box 24, a developing roller 26, and a cleaning member 28. The charging roller 22 uniformly charges the surface of the roller-shaped image carrier 20. The optical box 24 illuminates image light onto the image carrier 20 on the basis of image data and forms a latent image formed by the difference in electrostatic potentials. The developing roller 26 selectively provides toner onto the latent image so as to make the latent image visible. The cleaning member 28 slidingly-contacts the image carrier 20 after the toner image has been transferred so as to clean the toner remaining on the image carrier 20.

The image carrier 20 includes a photosensitive layer on the surface (peripheral surface) thereof. After this surface (the peripheral surface) has been charged uniformly by the charging roller 22, the surface (peripheral surface) is exposed by the laser beam (image light) illuminated from the optical box 24. Due to the potential of a portion which is exposed being decreased, an electrostatic latent image (image) is formed. Note that the surface (peripheral surface) of the image carrier 20 is charged substantially uniformly by the charging roller 22 such that the charging roller 22 abuts the image carrier 20, voltage is applied therebetween, and discharging occurs within the minute gap in a vicinity of the abutting portion.

The optical box 24 scans laser beam, which is turned on-and-off, on the surface (peripheral surface) of the image carrier 20, and forms an electrostatic latent image based on image data on the surface (peripheral surface) of the image carrier 20. Note that a structure in which light-emitting elements, such as LEDs or the like, are lined-up and the light-emitting elements are turned on-and-off on the basis of image data, or the like can be considered for the optical box 24.

The developing roller 26 is disposed adjacent to the image carrier 20 so as to face the image carrier 20. Developing bias voltage is applied between the developing roller 26 and the image carrier 20. In this way, a developing bias electric field is formed between the developing roller 26 and the image carrier 20, and the toner with electric charge moves to the exposed portions on the image carrier 20 and forms a visible image.

On the other hand, the conveying unit 18 includes the conveying belt 34 which is span-stretched around at least a driving roller 30 and a driven roller 32. At the inner surface side of the conveying belt 34, plural (four, in correspondence with respective colors which will be described later) transfer rollers 36 are disposed so as to be separated from one another at predetermined intervals, at predetermined positions between the driving roller 30 and the driven roller 32.

When the front cover 14 is closed (i.e., when the front cover 14 is rotated toward the main body frame 12 and closes the image carriers 20 and the like), the transfer rollers 36 oppose the image carriers 20 with the conveying belt 34 nipped therebetween. Due to transfer electric fields being formed between the transfer rollers 36 and the image carriers 20, the transfer rollers 36 cause the toner images (unfixed) on the surfaces of the image carriers 20 to be transferred onto a recording sheet P which passes by in a state of being attracted to the conveying belt 34.

The conveying unit 18 includes a charging roller 35 which opposes the driven roller 32 with the conveying path of the recording sheet P therebetween. The charging roller 35, together with the driven roller 32, nips the recording sheet P and the conveying belt 34, and the charging roller 35 charges the recording sheet P so as to cause the recording sheet P to be electrostatically attracted to the attracting/conveying surface of the conveying belt 34.

The conveying unit 18 includes a cleaning section 84 which cleans the conveying belt 34. The cleaning section 84 includes a recovery box 86 provided between the conveying belt 34 and the front cover 14, and a blade 88 which is supported at the recovery box 86 and whose distal end portion is made to contact the conveying belt 34. The cleaning section 84 scrapes-off, by the blade 88, the toner and paper dust and the like adhering to the conveying belt 34, and accumulates, in the recovery box 86, the toner and paper dust and the like scraped-off by the blade 88.

The conveying unit 18 includes a both-faces conveying section 90 which reverses the front and back of the recording sheet P, on whose obverse printing has been carried out, and conveys the recording sheet P to the attracting/conveying surface of the conveying belt 34. The both-faces conveying section 90 includes plural conveying roller pairs 92 which are arranged in the vertical direction between the conveying belt 34 and the front cover 14, and a guide plate 55 which guides the recording sheet P which is conveyed by the conveying roller pairs 92.

The developing units 16 are disposed in the vertical direction in the order of, for example, yellow (Y), magenta (M), cyan (C), and black (K) from the bottom, such that full-color printing is possible. The fixing device 38 is disposed further downstream in the conveying direction of the recording sheet P (further toward the top portion of the main body frame 12) than these developing units 16Y through 16K.

The fixing device 38 includes a heating roller 40 and a pressurizing roller 42 whose peripheral surfaces oppose one another and press-contact (nip) one another at a predetermined pressure. By the unfixed toner image, which has been transferred on the recording sheet P, being heated and pressurized by the heating roller 40 and the pressurizing roller 42, the toner image is fixed on the recording sheet P.

The recording sheet P, which has been heated and pressurized by the fixing device 38 (the heating roller 40 and the pressurizing roller 42) such that the toner image is fixed thereon, is discharged-out onto a catch tray 44 by sheet discharging rollers 102. Further, after the transfer of the toner images onto the recording sheet P is finished, the surfaces (peripheral surfaces) of the image carriers 20 are subjected to cleaning processing by the cleaning members 28, so as to prepare for the next image forming processing.

A sheet feed cassette 46, which is removable, is provided at the lower portion of the main body frame 12. The sheet feed cassette 46 can be pulled in and pulled out in the direction in which the recording sheets P are fed-out, and can feed the recording sheets P suitably.

A sheet feeding roller pair 48, which sends the recording sheets P out one-by-one from the interior of the sheet feed cassette 46, is provided in a vicinity of the distal end portion of the sheet feed cassette 46. The recording sheet P, which is sent-out by the sheet feeding roller pair 48, is sent-out by a resist roller pair 45 at a predetermined time to the attracting/conveying surface of the conveying belt 34, and is conveyed to the positions of transfer of the toner images of the respective colors.

The structure of the exterior of the image forming device 10 will be described next.

As shown in FIGS. 3 through 6, the front cover 14, which is a dark color such as black or the like, is provided at an operation panel 210 side (hereinafter called the "user side") of the main body frame 12. A right cover 50 and a left cover 52, which are a light color such as silver or the like, are respectively mounted to the side surface of the main body frame 12 at the right side (hereinafter called "right side") as seen from the operation panel 210 side and the side surface of the main body frame 12 at the left side (hereinafter called "left side") as seen from the operation panel 210 side.

The lower end portion of the front cover 14 is rotatably supported at the operation panel 210 side of the main body frame 12, and can be tilted forward. The front cover 14 is structured by a front surface cover portion 14A, a top surface cover portion 14B, and side walls 14C and 14D. The front surface cover portion 14A opens and closes an opening 12A provided at the user side of the main body frame 12. The top surface cover portion 14B is bent from the upper end of the front surface cover portion 14A toward the main body frame 12 and opens and closes the user side of the top surface of the main body frame 12. The side walls 14C and 14D are bent toward the main body frame 12 from the left and right end portions of the front cover 14 respectively. The side surfaces 14C and 14D cover the opening 12A side edge portions of the left side surface and the right side surface of the main body frame 12 respectively.

The right cover 50 is fixed to the right side surface of the main body frame 12, and the left cover 52 is fixed to the left side surface of the main body frame 12.

Due to plural (in the present exemplary embodiment, four, as illustrated) spacer members 50A, 50B, 50C, 50D being formed integrally with the user side edge portion of the reverse surface of the right cover 50, a gap is formed between the right cover 50 and the right side surface of the main body frame 12. The side wall 14D of the front cover 14 is inserted into this gap. Further, due to plural (in the present embodiment, three, as illustrated) spacer members 52A, 52B, 52D being formed integrally with the user side edge portion of the reverse surface of the left cover 52, a gap is formed between the left cover 52 and the left side surface of the main body frame 12. The side wall 14C of the front cover 14 is inserted into this gap.

Therefore, the edges of the right cover 50 and the left cover 52 are exposed and emphasized. The main body frame 12 is not exposed from the peripheries of the edges of the right cover 50 and the left cover 52, and the colors of these regions are a dark color such as black or the like. Therefore, the aesthetic appeal of the exterior is improved.

The spacer members 50A, 50B, 50C are arranged in that order from the lower side at the user-side edge side of the right cover 50, and the spacer member 50D is disposed at the top-side edge side of the right cover 50. Further, the spacer members 52A, 52B are arranged in that order from the lower side at the user-side edge side of the left cover 52, and the spacer member 52D is disposed at the top-side edge side of the left cover 52. The spacer members 50A, 50B, 50D have the same shape. Further, the spacer member 52A and the spacer member 50A, the spacer member 52B and the spacer member 50B, and the spacer member 52D and the spacer member 50D, respectively have shapes and positions which are symmetric at the left and the right.

The spacer members 50A, 50B, 50C are members which are hook-shaped in top view and which stand erect at the user-side edge side of the reverse surface of the right cover 50 and are bent toward the user side such that distal end portions thereof project from the edge side, and the spacer members 50A, 50B, 50C abut the right side surface of the main body frame 12. The spacer members 52A, 52B are members which are hook-shaped in top view and which stand erect at the user-side edge side of the reverse surface of the left cover 52 and are bent toward the user side such that distal end portions thereof project from the edge side, and the spacer members 52A, 52B abut the left side surface of the main body frame 12. Further, the spacer member 50D is a member which is hook-shaped in front view and which stands erect at the top-side edge side of the reverse surface of the right cover 50 and is bent toward the top side such that distal end portion thereof projects from the edge side, and the spacer member 50D abuts the right side surface of the main body frame 12. The spacer member 52D is a member which is hook-shaped in front view and which stands erect at the top-side edge side of the reverse surface of the left cover 52 and is bent toward the top side such that distal end portion thereof projects from the edge side, and the spacer member 52D abuts the left side surface of the main body frame 12.

Further, as shown in FIGS. 5 through 8, ribs 50F and 52F, which project-out toward the right cover 50 and the left cover 52, are formed at the spacer members 50A, 50B, 50C, 50D and the spacer members 52A, 52B, 52D, respectively. The ribs 50F, 52F of the spacer members 50A, 50B, 50C, 52A, 52B extend in the front-back direction of the device, and taper portions 50T, 52T (see FIG. 7), whose widths gradually become narrower toward the user side, are formed thereat. The ribs 50F, 52F of the spacer member 50D and the spacer member 52D extend in the top-bottom direction, and the taper portions 50T, 52T, whose widths gradually become narrower toward the top side, are formed thereat.

Ribs 50E, which oppose the ribs 50F of the spacer members 50A, 50B, 50C, 50D, are formed at the reverse surface of the right cover 50. Ribs 52E, which oppose the ribs 52F of the spacer members 52A, 52B, 52D, are formed at the reverse surface of the left frame 52.

The ribs 50E, which oppose the ribs 50F of the spacer members 50A, 50B, 50C, extend in the front-back direction of the device, and taper portions 50P (see FIG. 7), whose widths gradually become narrower toward the user side, are formed thereat. Further, the rib 50E, which opposes the rib 50F of the spacer member 50D, extends in the up-down direction, and the taper portion 50P, whose width gradually becomes narrower toward the top side, is formed thereat.

The ribs 52E, which oppose the ribs 52F of the spacer members 52A, 52B, extend in the front-back direction of the device, and taper portions 52P (see FIG. 7), whose widths gradually become narrower toward the user side, are formed thereat. Further, the rib 52E, which opposes the rib 52F of the spacer member 52D, extends in the up-down direction, and the taper portion 52P, whose width gradually becomes narrower toward the top side, is formed thereat.

Each of the minimum values of intervals between the ribs 50E and the ribs 50F of the spacer members 50A, 50B, 50C, 50D is smaller than the thickness of the side wall 14D, and each of the maximum values of these intervals is larger than the thickness of the side wall 14D. Moreover, each of the minimum values of the intervals between the ribs 52E and the ribs 52F of the spacer members 52A, 52B, 52D is smaller than the thickness of the side wall 14C, and each of the maximum values of these intervals is larger than the thickness of the side wall 14C.

Figure 8:
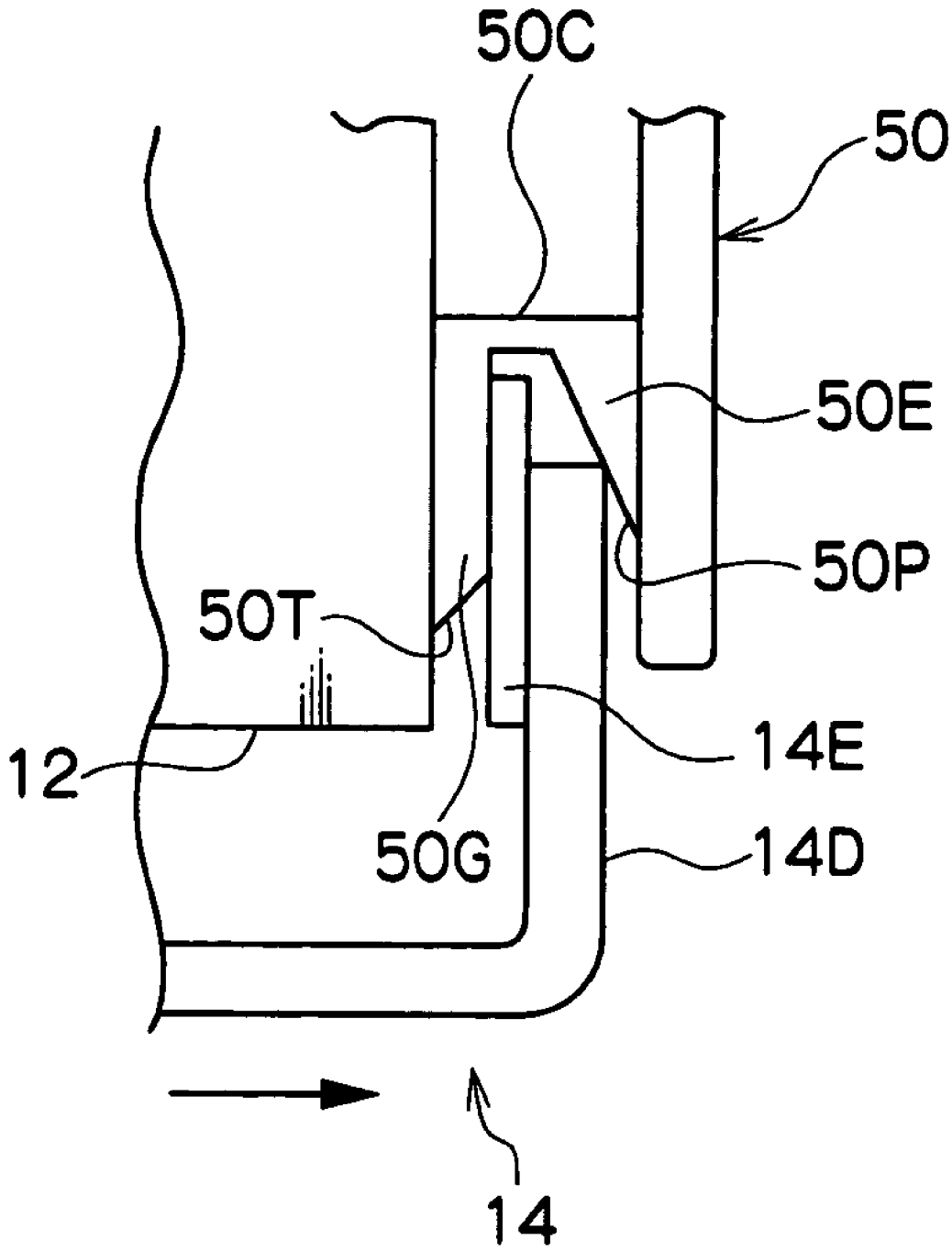
FIG. 8 is a plan view showing an engaged state of the side wall of the front cover and a spacer member of the image forming device of FIG. 1.

As shown in FIG. 8, three ribs 50F, 50G are formed at the spacer member 50C. The one rib 50F at the lower side has the same shape and dimensions as the ribs 50F of the spacer members 50A, 50B. The two ribs 50G at the upper side and in the middle have narrower widths than the ribs 50F of the spacer members 50A, 50B. Further, a rib 14E, which abuts the two ribs 50G which are at the upper side and the middle of the spacer member 50C, is formed at the edge of the reverse surface of the side wall 14D. The rib 14E projects from the edge of the side wall 14D toward the main body frame 12, and projects from the reverse surface of the side wall 14D toward the spacer member 50C by an amount corresponding to the thickness thereof.

The front cover 14 is supported at the main body frame 12 such that there is some play in the left-right direction (the axial direction of the rotational axis). In the state in which the front cover 14 is closed, the rib 14E abuts the two ribs 50G at the upper side and the middle of the spacer member 50C, such that the front cover 14 is moved toward the right side.

Figure 7:
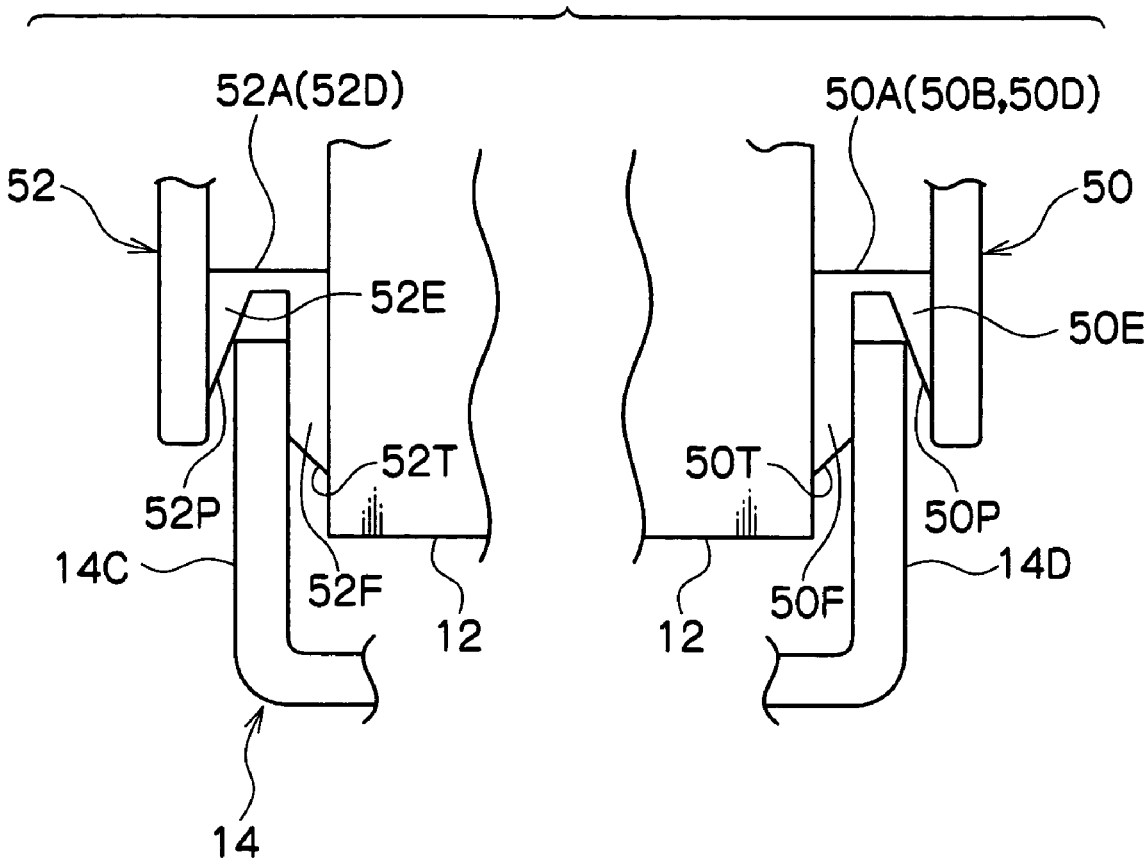
FIG. 7 is a plan view showing an engaged state of side walls of a front cover and spacer members of the image forming device of FIG. 1.

In this state, as shown in FIG. 7, the side wall 14D is nipped by the ribs 50F of the spacer members 50A, 50B, 50C, 50D and the four ribs 50E which oppose them, and the side wall 14C is nipped by the ribs 52F of the spacer members 52A, 52B, 52D and the three ribs 52E which oppose them, such that the front cover 14 is positioned.

Figure 9:
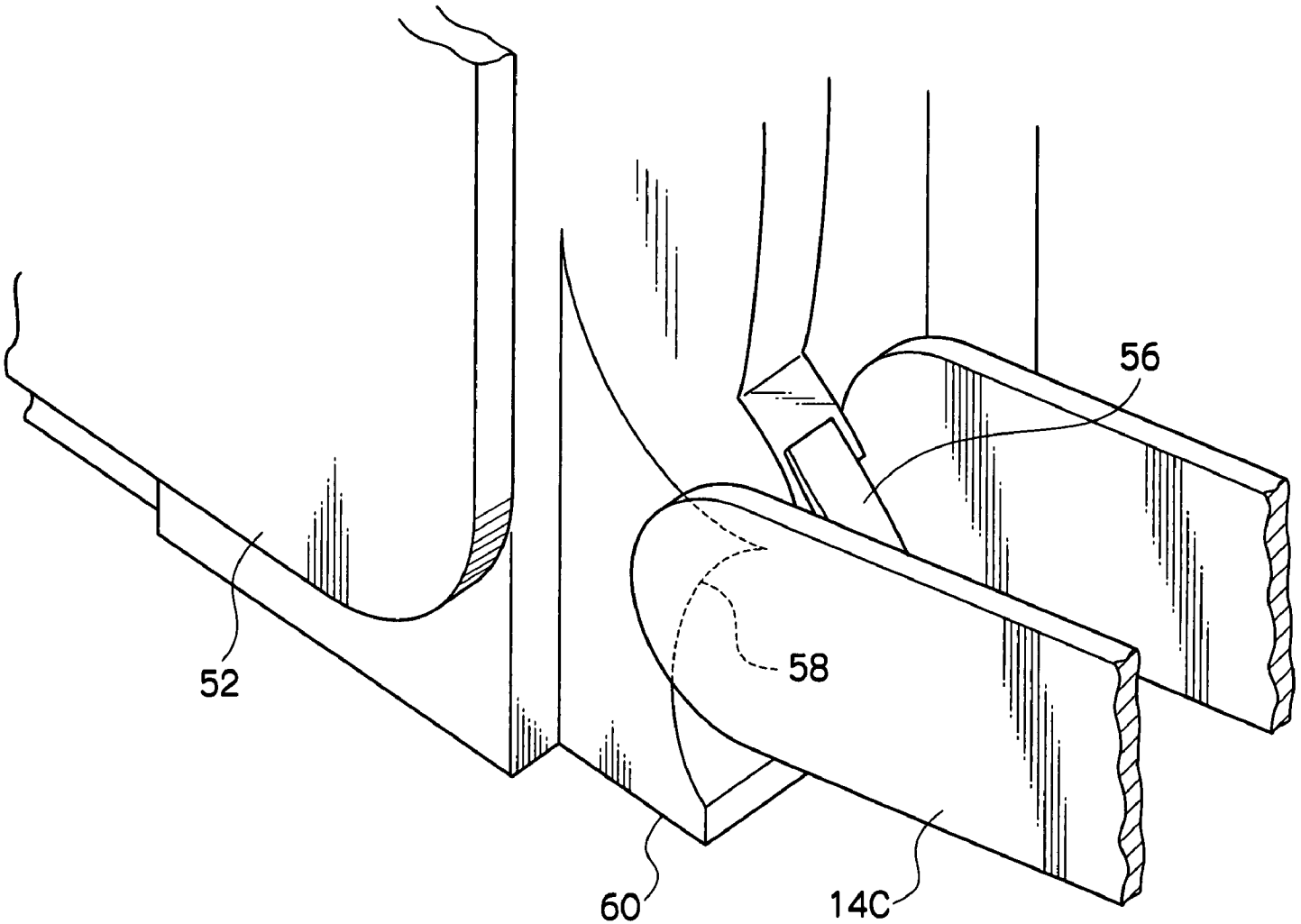
FIG. 9 is a perspective view showing a portion of the image forming device of FIG. 1 in an enlarged manner.

Further, as shown in FIG. 9, guide walls 58, which abut the inner surfaces of the side walls 14C and 14D, are provided between the lower end sides of the side walls 14C and 14D (only 14C is illustrated) and hinges 56 which support the front cover 14 such that the front cover 14 is rotatable around the lower portion of the main body frame 12. The guide walls 58 are formed integrally with frames 60 of hinge units at which the hinges 56 are provided, which frames 60 are mounted to the lower portion of the main body frame 12. The guide walls 58 always abut the inner walls of the side walls 14C and 14D, from the closed state to the completely open state. Play in the left-right direction of the main body frame 12 is thereby restricted.

Figure 10:
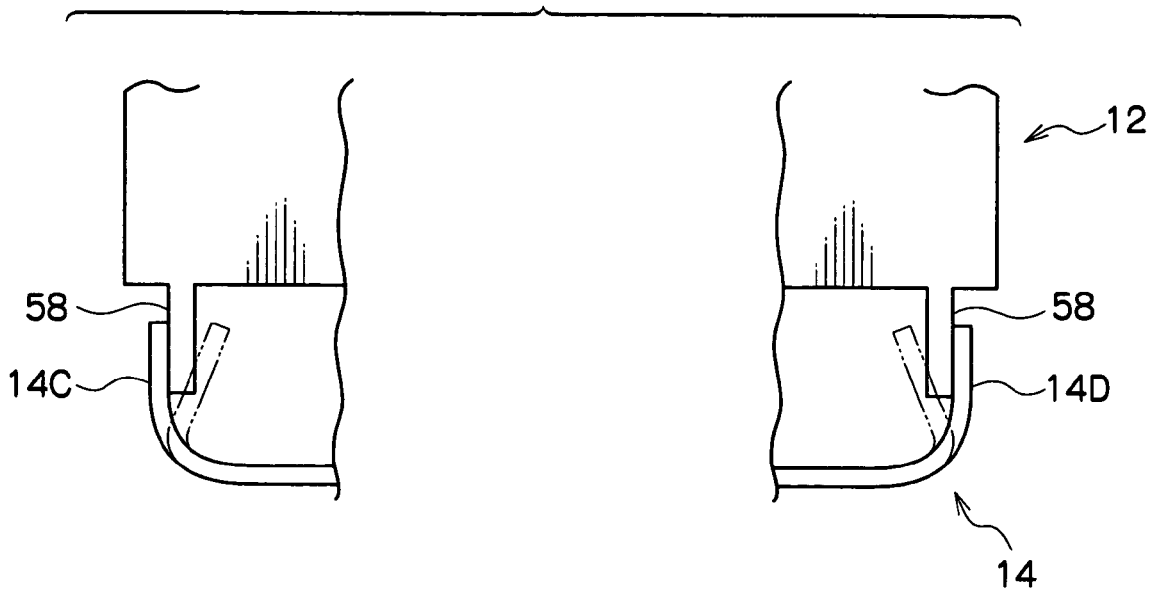
FIG. 10 is a schematic plan view showing peripheries of hinge portions of the image forming device of FIG. 1.

There may be a case in which, in molding the front cover 14, the side walls 14C and 14D are completed in states of being tilted toward the inner side as shown by the chain-lines in FIG. 10. However, when the front cover 14 is mounted to the main body frame 12, the posture is corrected by the guide walls 58 as shown by the solid lines. In this way, positional offset between, on the one hand, the side walls 14C and 14D, and, on the other hand, the spacer members 50A through 50D and 52A, 52B, 52D, is reduced, and therefore, the operability at the time of closing the front cover 14 is improved.

The operation of opening and closing the front cover 14 will be described hereinafter.

Figure 3:
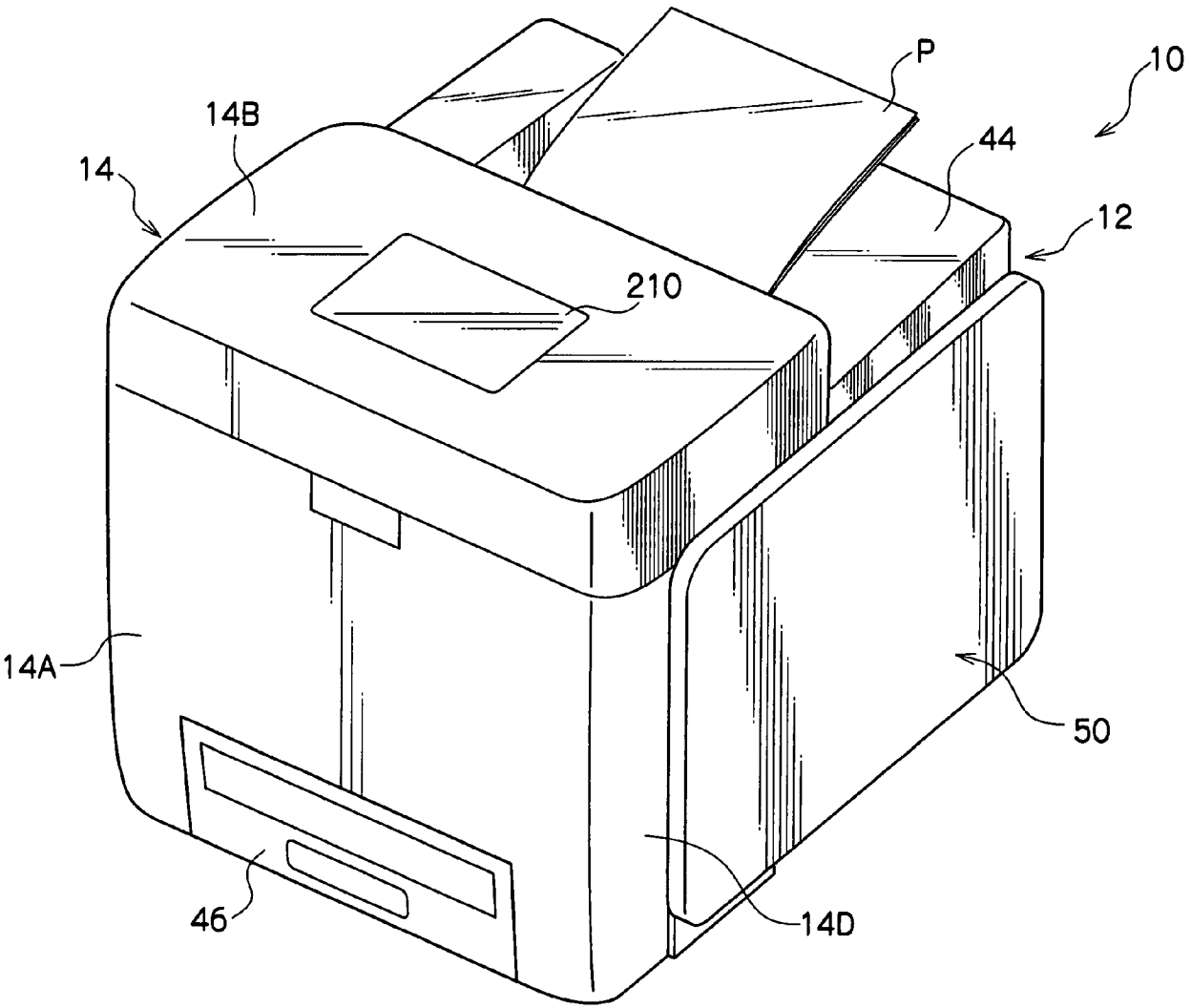
FIG. 3 is a perspective view showing the image forming device of FIG. 1.
Figure 4:
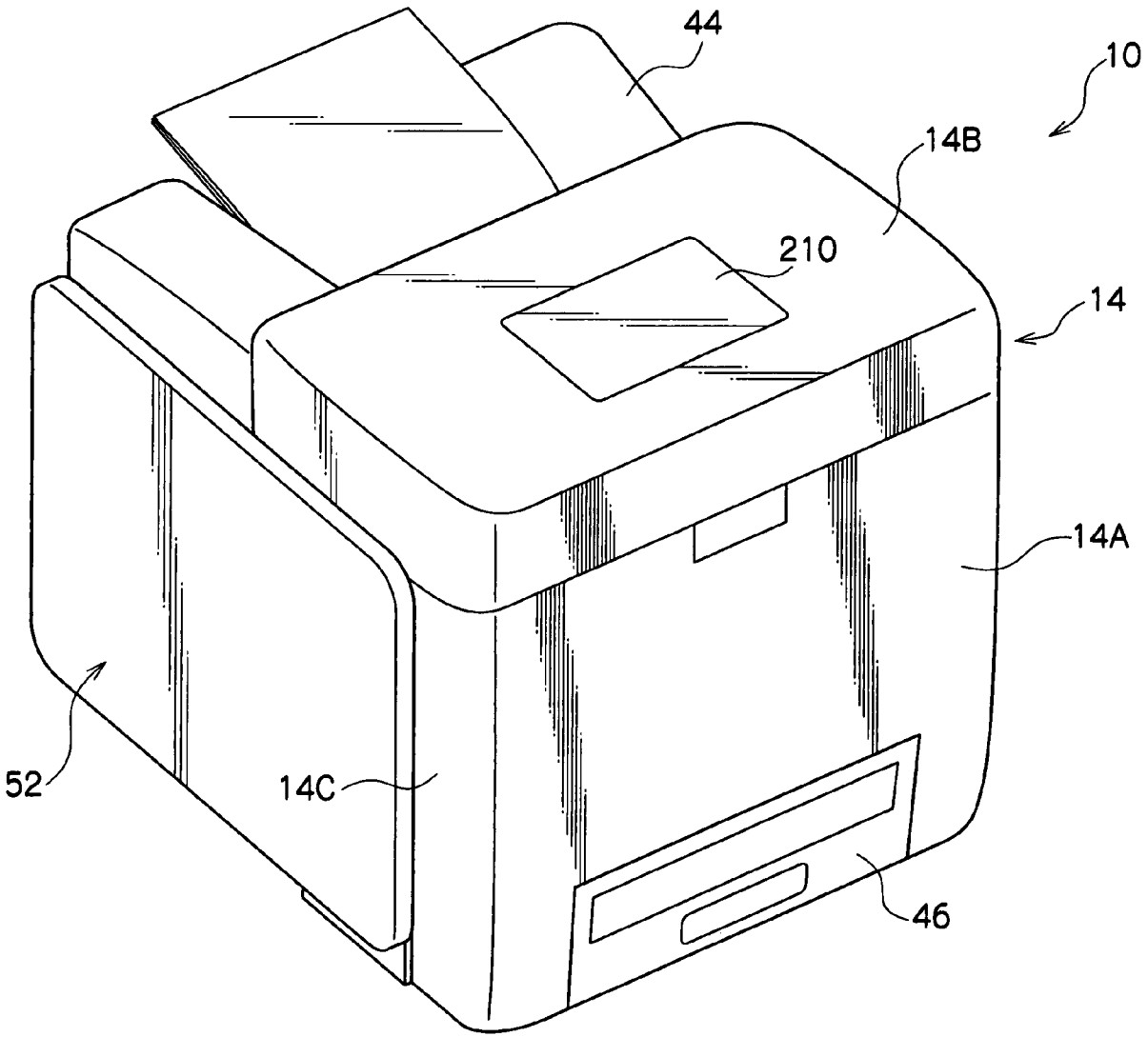
FIG. 4 is a perspective view showing the image forming device of FIG. 1.

As shown in FIGS. 3 and 4, in the state in which the front cover 14 is closed, the side walls 14D and 14C are respectively nipped between the ribs 50E and 50F of the spacer members 50A through 50D, and between the ribs 52E and 52F of the spacer members 52A, 52B, 52D. The side wall 14C is positioned so as to be apart from the left cover 52, and the side wall 14D is positioned so as to be apart from the right cover 50.

In this state, the side walls 14C and 14D are between the main body frame 12 and the left cover 52, and between the main body frame 12 and the right cover 50, respectively, and the edges of the left cover 52 and the right cover 50 are exposed. Further, the main body frame 12 is not exposed from between the side wall 14C and the edge of the left cover 52 nor from between the side wall 14D and the edge of the right cover 50, and the peripheries of the edges of the left cover 52 and the right cover 50 are a dark color such as black or the like. Note that, if separate members of a dark color such as black or the like are mounted to the peripheries of the edges of the left cover 52 and the right cover 50, or if the peripheries of the edges of the left cover 52 and the right cover 50 are painted a dark color such as black or the like, or the like, there will be a similar appearance even if the side walls 14C and 14D are not disposed at the inner sides of the left cover 52 and the right cover 50 respectively, although the cost will clearly increase.

Accordingly, by disposing the side walls 14C and 14D at the inner sides of the left cover 52 and the right cover 50 respectively, the degrees of freedom in the design of the exterior can be increased while costs are reduced.

Figure 5:
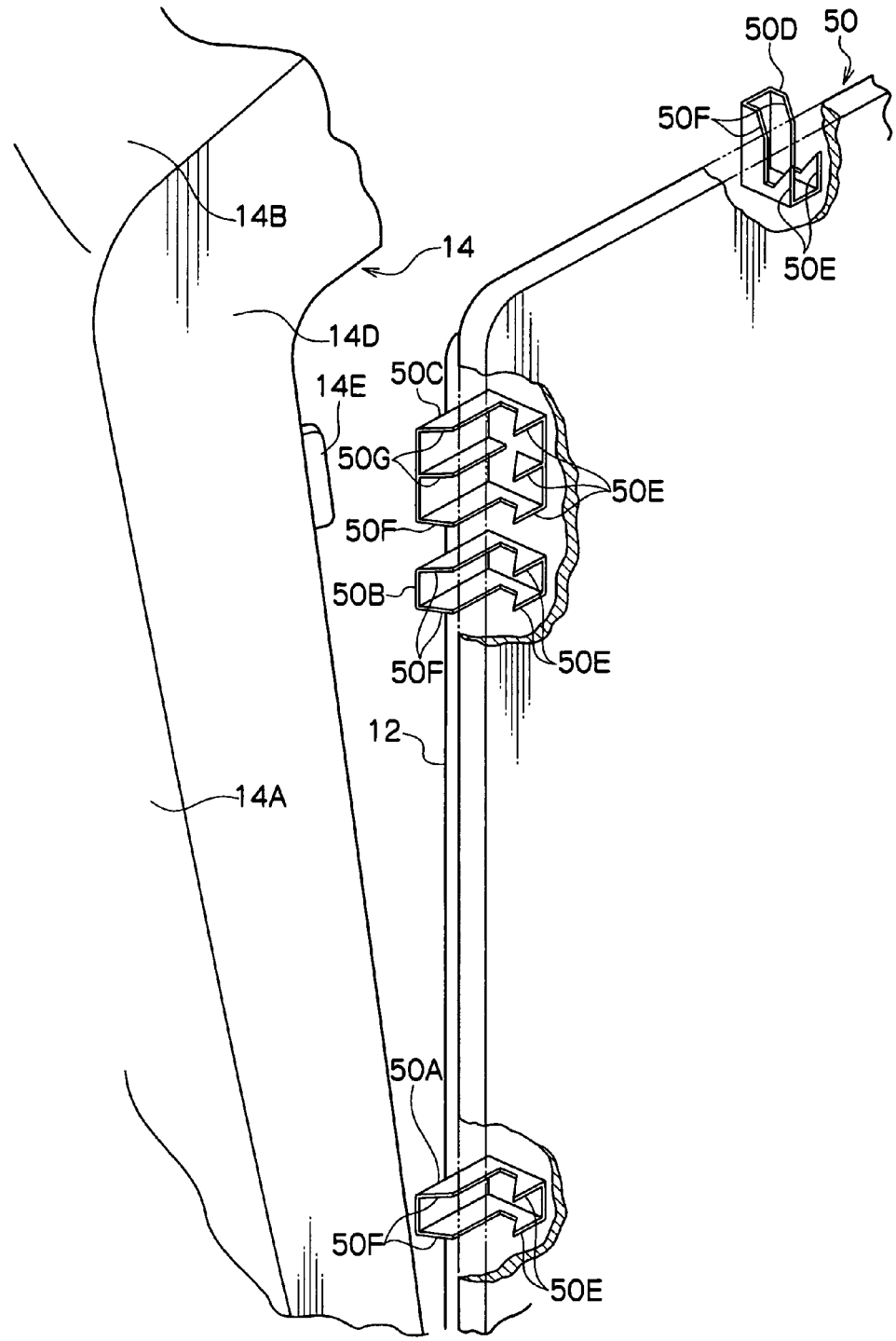
FIG. 5 is a perspective view showing a portion of the image forming device of FIG. 1 in an enlarged manner.
Figure 6:
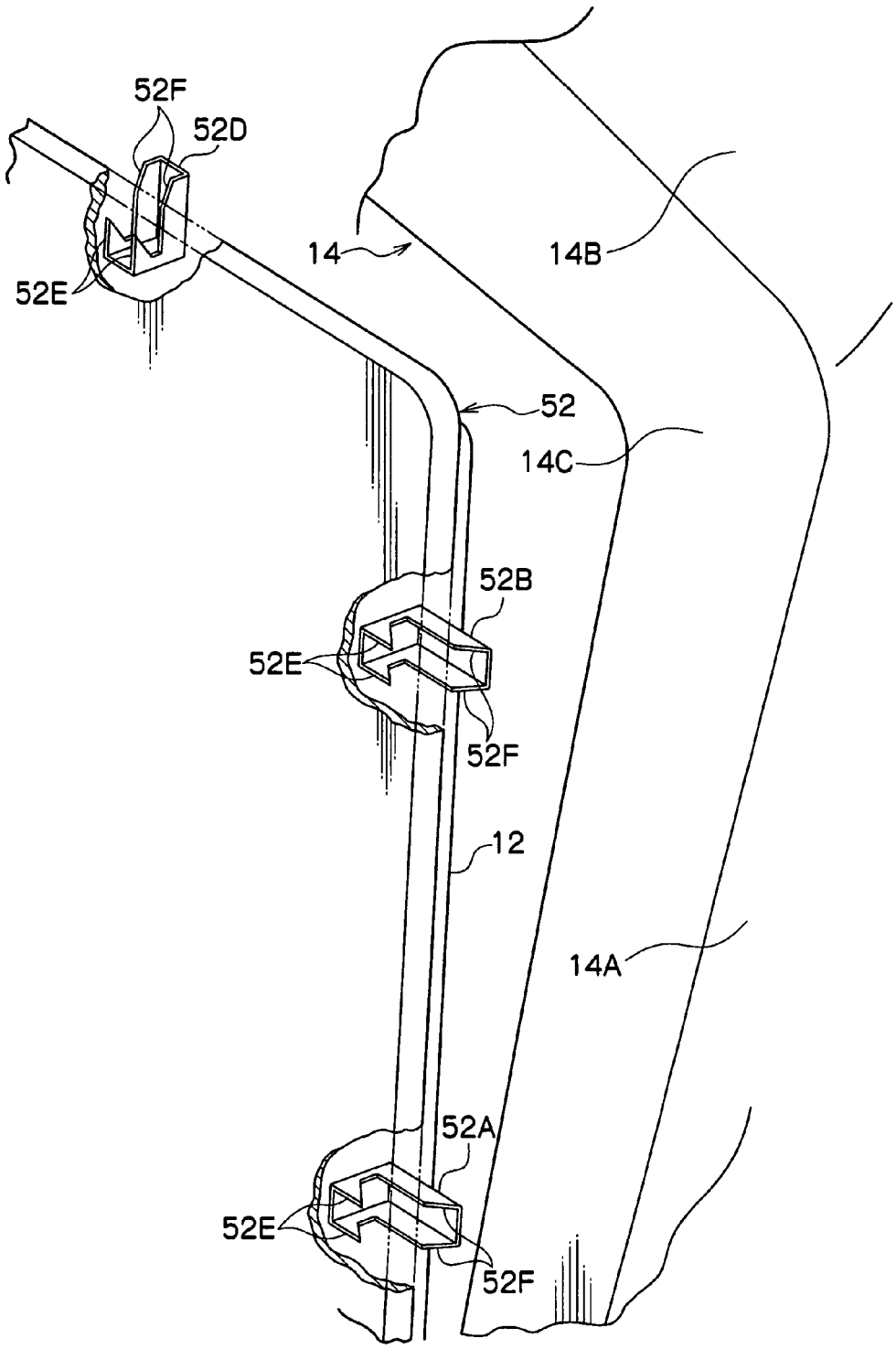
FIG. 6 is a perspective view showing a portion of the image forming device of FIG. 1 in an enlarged manner.

As shown in FIGS. 5 and 6, at the time of opening the front cover 14, the side walls 14D and 14C are pulled-out respectively from between the ribs 50E and 50F of the spacer members 50A through 50D, and between the ribs 52E and 52F of the spacer members 52A, 52B, 52D in order from the upper side.

Then, at the time of closing the front cover 14, first, the side wall 14D is fit-in between the ribs 50F and 50E of the spacer member 50A, and the side wall 14C is fit-in between the ribs 52F and 52E of the spacer member 52A. Then, the side wall 14D is fit-in between the ribs 50F and 50E of the spacer member 50B, and the side wall 14C is fit-in between the ribs 52F and 52E of the spacer member 52B. Finally, the side wall 14D is fit-in between the ribs 50F and 50E of the spacer member.50D, and the side wall 14C is fit-in between the ribs 52F and 52E of the spacer member 52D.

At this time, before the side wall 14D is fit between the ribs 50F and 50E of the spacer member 50B, the rib 14E abuts the ribs 50G of the spacer member 50C, and force directed toward the right is applied to the rib 14E from the taper portions 50T of the ribs 50Q and the front cover 14 is urged toward the right. In this way, the front cover 14 is moved toward the right cover 50 side, and there is no play in the left-right direction. Therefore, the side wall 14D can be nipped between the ribs 50F and 50E of the spacer members 50B through 50D, and the side wall 14C can be nipped between the ribs 52F and 52E of the spacer members 52B, 52C, 52D, without sliding and rubbing against the right cover 50 and the left cover 52. Accordingly, it is possible to prevent the paint of the side walls 14C, 14C from being stripped or scratched, and therefore, a deterioration in the aesthetic appeal of the exterior can be suppressed.

Further, the side walls 14C and 14D are set at the spacer members 50A through 50D and 52A, 52B, 52D, in order from the bottom. Therefore, the side walls 14C and 14D are set at the upper side spacer members 50B through 50D and 52B, 52D while the front cover 14 flexes and shifts by an amount corresponding to the amount of play in the left-right direction. Thus, the operability can be improved as compared with a case in which the side walls 14C and 14D are fit-into all of the spacer members 50A through 50D, 52A, 52B, 52D simultaneously. Moreover, because the degree to which the part-accuracy of the front cover 14, the right cover 50, and the left cover 52 is required is lowered, the manufacturing cost of the parts can be reduced.

At least one of the arrangement of and the number of the plural positioning portions (portions between the ribs 50F and 50E of the spacer members 50A, 50B, 50C, 50D and portions between the ribs 52F and 52E of the spacer member 52A, 52B, 52D) differs between the right side and the left side, and the side wall 14C and the side wall 14D can be set alternately at the positioning portions at the time of closing the front cover 14. Therefore, the operability is improved. Further, because the degree to which the machining accuracy of the front cover 14 and the spacer members 50A through 50D, 52A, 52B, 52D is required is lowered, the manufacturing cost of the parts can be reduced.

By forming the front surface cover portion 14A and the top surface cover portion 14B integrally, the strength of the front surface cover portion 14A is increased. Therefore, deformation and breakage of the front surface cover portion 14A due to the load applied thereto at the time of opening or closing the front cover 14 can be suppressed.

In the present embodiment, the urging section which urges the front cover 14 toward one end side in the axial direction of the rotational axis is provided as the rib 14E (projecting portion) provided at the side wall 14D and the taper portions 50T (taper portions) of the ribs 50G provided between the main body frame 12 and the right cover 50. However, the projecting portion can be provided between the main body frame 12 and the right cover 50, and the taper portion can be provided at the side wall 14D. Or, these can be disposed at the left side of the main body frame 12.

Further, in the present embodiment, the present invention is described by using an electrophotographic type image forming device as an example. However, the present invention can be applied as well to image forming devices of other types, such as inkjet recording type image forming devices or the like.

The foregoing description of the exemplary embodiment has been provided for the purposes of illustration and description. It is not intended to be exhaustive or to limit the invention to the precise forms disclosed. Obviously, many modifications and variations will be apparent to practitioners skilled in the art. The exemplary embodiment are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device comprising:

a main body frame at which an opening is provided;

an image forming section that is accommodated in the main body frame, and that forms an image on a recording medium;

an opening/closing cover that is rotatably supported and opens and closes the opening, a bent portion of the opening/closing cover that is bent toward the main body frame covering an edge portion, at the side of the opening, of the main body frame in a state in which the opening/closing cover is closed; and a fixed cover that is provided integrally with the main body frame such that a space, into which the bent portion of the opening/closing cover can be inserted between the main body frame and the fixed cover, is formed between the main body frame and the fixed cover, and that covers the bent portion in the state in which the opening/closing cover is closed.

2. The image forming device of claim 1, further comprising a spacer member that is provided between the main body frame and the fixed cover, and that forms the space, into which the bent portion of the opening/closing cover can be inserted, between the main body frame and the fixed cover.

3. The image forming device of claim 2, further comprising a positioning portion that is provided between the main body frame and the fixed cover, and that, in the state in which the opening/closing cover is closed, positions the bent portion of the opening/closing cover while separating the bent portion from the fixed cover.

4. The image forming device of claim 3, further comprising a guide portion that guides the bent portion of the opening/closing cover to the positioning portion at a time of closing the opening/closing cover.

5. The image forming device of claim 3, wherein the positioning portion is a pair of ribs at which taper portions, whose widths gradually narrow toward the opening/closing cover, are formed, and, in the state in which the opening/closing cover is closed, the pair of ribs nipping the bent portion of the opening/closing cover.

6. The image forming device of claim 3, wherein the positioning portion is formed integrally with the fixed cover.

7. The image forming device of claim 3, wherein the bent portion is provided at both end sides of the opening/closing cover in an axial direction of a rotational axis of the opening/closing cover, and a plurality of the positioning portions are arranged in a direction orthogonal to the rotational axis of the opening/closing cover.

8. The image forming device of claim 7, wherein, at the time of closing the opening/closing cover, the plurality of positioning portions position the bent portions of the opening/closing cover sequentially in order from a side of the rotational axis of the opening/closing cover.

9. The image forming device of claim 7, wherein at least one of an arrangement of and a number of the plurality of positioning portions differs at one side and at another side in the axial direction of the rotational axis of the opening/closing cover.

10. The image forming device of claim 1, further comprising an urging section that urges the opening/closing cover toward one end side in an axial direction of a rotational axis, at a time of closing the opening/closing cover.

11. The image forming device of claim 10, wherein the urging section comprising:

a projecting portion provided at least one of
the bent portion of the opening/closing cover, and
between the main body frame and the fixed cover, and projecting toward one of the main body frame and the opening/closing cover; and a taper portion provided at least one of
between the main body frame and the fixed cover, and
the bent portion of the opening/closing cover, and abutting the projecting portion at the time of closing the opening/closing cover, and causing force, which is directed toward one side or is directed toward another side in the axial direction of the rotational axis of the opening/closing cover, to be applied to the projecting portion.

12. The image forming device of claim 11, wherein, at the time of closing the opening/closing cover, the projecting portion projecting from the bent portion of the opening/closing cover toward the main body frame abuts the taper portion provided between the main body frame and the fixed cover.

13. The image forming device of claim 11, wherein, at the time of closing the opening/closing cover, the projecting portion projecting toward the opening/closing cover from between the main body frame and the fixed cover abuts the taper portion provided at the bent portion of the opening/closing cover.

14. The image forming device of claim 11, the taper portion further comprising opposing rib portions having a gap therebetween, wherein a width of the gap varies such that a minimum value of the gap is smaller than a width of the projection portion and a maximum value of the gap is larger than the width of the projection portion.

15. The image forming device of claim 1, further comprising correcting members provided at both end portions of the main body frame in an axial direction of a rotational axis of the opening/closing cover, and abutting inner sides of the bent portions of the opening/closing cover to correct postures of the bent portions.

16. The image forming device of claim 1, further comprising a top surface cover that is formed integrally with an end portion of the opening/closing cover, and that opens and closes a top surface of the main body frame at opening/closing operation of the opening/closing cover.

17. The image forming device of claim 1, wherein a portion of the bent portion is exposed to an exterior of the image forming device when the opening/closing cover is closed.

18. An image forming device comprising:

a main body frame at which an opening is provided;

an opening/closing cover that is rotatably supported and opens and closes the opening, a bent portion of the opening/closing cover that is bent toward the main body frame covering an edge portion, at the side of the opening, of the main body frame in a state in which the opening/closing cover is closed; and a fixed cover that is provided integrally with the main body frame and that covers the bent portion in the state in which the opening/closing cover is closed.

* * * * *